US006522750B1

(12) United States Patent
Risse et al.

(10) Patent No.: US 6,522,750 B1
(45) Date of Patent: Feb. 18, 2003

(54) METHOD AND CORRESPONDING SYSTEM FOR INFLUENCING THE STEREO CHANNEL SEPARATION OF AN AUDIOSIGNAL

(75) Inventors: Marcus Risse, Giesen (DE); Bjoern Jelonnek, Sarstedt (DE); Rüdiger Trinks, Liebenburg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/380,143

(22) PCT Filed: Jan. 24, 1998

(86) PCT No.: PCT/DE98/00215

§ 371 (c)(1),
(2), (4) Date: Aug. 25, 1999

(87) PCT Pub. No.: WO98/38835

PCT Pub. Date: Sep. 3, 1998

(30) Foreign Application Priority Data

Feb. 26, 1997 (DE) ..... 197 07 673

(51) Int. Cl.[7] ..... H04H 5/00
(52) U.S. Cl. ..... 381/10; 381/2
(58) Field of Search ..... 381/1, 2, 10, 11, 381/12, 16; 455/226.2

(56) References Cited

U.S. PATENT DOCUMENTS 4,390,749 A * 6/1983 Pearson ..... 381/10
4,415,768 A * 11/1983 Carver ..... 381/10
5,201,062 A * 4/1993 Nakamura et al. ..... 381/10
5,390,344 A * 2/1995 Nagata ..... 381/10
5,455,866 A * 10/1995 Ohashi ..... 381/10
5,592,557 A * 1/1997 Chahabadi et al. ..... 381/10
5,661,809 A * 8/1997 Chahabadi et al. ..... 381/10
5,671,286 A * 9/1997 Gottfired et al. ..... 381/10
5,703,954 A * 12/1997 Dapper et al. ..... 381/10
5,784,465 A * 7/1998 Fujiwara ..... 381/10

FOREIGN PATENT DOCUMENTS

| | | |
|---|---|---|
| DE | 43 23 015 | 1/1994 |
| EP | 0 399 557 | 11/1990 |
| EP | 0 617 519 | 9/1994 |
| FR | 2 724 027 | 3/1996 |
| JP | 01 251201 | 10/1989 |

* cited by examiner

*Primary Examiner*—Xu Mei
(74) *Attorney, Agent, or Firm*—Kenyon & Kenyon

(57) ABSTRACT

A method for influencing the channel separation of an audio signal to be reproduced, obtained from a received radio signal, in a radio receiver, as well as a radio receiver for carrying out the method includes an auxiliary field strength signal derived from the received field strength of the received radio signal, and an auxiliary interference signal derived from signals indicating reception interference events, being combined with one another and with an auxiliary channel separation signal that is derived from a signal indicating the frequency of interference events, to yield a factor D which influences the stereo channel separation.

21 Claims, 3 Drawing Sheets

METHOD AND CORRESPONDING SYSTEM FOR INFLUENCING THE STEREO CHANNEL SEPARATION OF AN AUDIOSIGNAL

FIELD OF THE INVENTION

The present invention relates to a method for influencing the stereo separation of an audio signal that is to be reproduced, and to a radio receiver for carrying out the method.

BACKGROUND INFORMATION

Modern radio transmitters emit radio signals whose signal format makes possible the transmission of stereophonic audio signals and allows the spatial sound of a stereophonic reproduction to be clearly audible at the receiver end.

This advantage is lost if a radio signal that is to be received is present at the receiving location with only a low field strength, since interference-free channel separation requires a minimum received field strength for a radio signal received at the receiving location. Radio receivers, in particular, car radios, have therefore been equipped for some time with a switching transition or continuous transition from stereophonic to monophonic reception, which depends on the received field strength of a received radio signal. In radio receivers of this kind, the channel separation is automatically reduced when there is a decrease in the received field strength.

Further reception interference events often occur in addition to the fluctuation in the received field strength of a received radio signal, for example, multipath reception of a tuned-in radio transmitter. Under such reception conditions it is disadvantageously noticeable, even with the aforesaid stereo radio receivers in which the continuous mono-stereo transition is set for optimum channel separation, that good stereo reception is suddenly disrupted when the vehicle enters a multipath reception area; this often occurs only over short distances. Stereo-capable radio receivers have therefore been equipped with a detector for interference events, for example, multipath reception of the tuned-in transmitter, whose output signal controls a switcher which forces the receiver to switch to monophonic reproduction of the received radio signal.

European Patent No. 0 617 519 describes a circuit arrangement for a radio receiver of this kind in which a signal indicating the received field strength is derived from the received field strength of a received radio signal; in which an interference signal indicating the reception interference events is derived from the received radio signal; and in which the signal indicating the received field strength, and the interference signal, are combined in multiplicative fashion to form a factor, delivered to a stereo decoder, for influencing the stereo channel separation of an audio signal that is to be reproduced.

On journeys affected by short-term multipath reception, e.g., on streets with tall buildings or in mountainous areas, alternations between single-path reception and multipath reception often occur very quickly, and result in correspondingly frequent switchovers from stereo reproduction to monophonic reproduction of a stereo transmission. This effect has long been perceived as so annoying that drivers in mountainous areas switch off the stereo decoder when receiving modern stereo transmitters, and dispense entirely with stereo reproduction.

Conventional radio receivers have the capability for analyzing data transmitted by way of the Radio Data System (RDS), which for the purpose of optimizing the reception quality of a received radio program are tuned briefly from a currently tuned-in transmission frequency to an alternative transmission frequency over which the same program is being transmitted; during the dwell time on the alternative transmission frequency, its reception quality is determined, and then the receiver is set to the transmission frequency having the best reception conditions. The information concerning the alternative transmission frequency is derived, for example, from the alternative frequency (AF) data transmitted over the Radio Data System.

Tuning the radio receiver to an alternative transmission frequency, whose received field strength may differ greatly from that of the transmission frequency originally tuned in, causes sudden and thus annoying changes in the stereo channel separation of a reproduced audio signal.

SUMMARY OF THE INVENTION

A method and a radio receiver according to the present invention have an advantage in that if reception conditions fluctuate greatly or if reception interference events (for example, multipath reception) occur frequently, rapid and frequent alternation between stereophonic and monophonic reproduction, and the negative auditory impression associated therewith, can be suppressed in favor of partially or completely monophonic reproduction.

It is particularly advantageous to embody the characteristic curves for evaluating the field strength signals indicating the received field strength of a radio signal in the form of step functions, since for the situation in which the method or the radio receiver according to the present invention is implemented with digital technology, such functions are particularly easy to implement.

Specifically, in the case of digital signal processing, it is also advantageous to implement a signal indicating the frequency of reception interference events by way of a counter which is incremented when an interference event occurs and decremented when interference is absent, since the clock signal required for this counter can easily be derived, for example, from the system clock, e.g., from the bit clock of the digital signals involved.

Lastly, it is particularly advantageous, in the case of radio receivers for the reception of Radio Data signals which perform automatic alternative frequency tests to optimize reception quality, to hold the channel separation auxiliary signal at its most recent value for the duration of one alternative frequency test, and to change it, if applicable, only after the alternative frequency test; in this fashion, large fluctuations in stereo channel separation during alternative frequency tests can be prevented.

DETAILED DESCRIPTION

Figure 1:
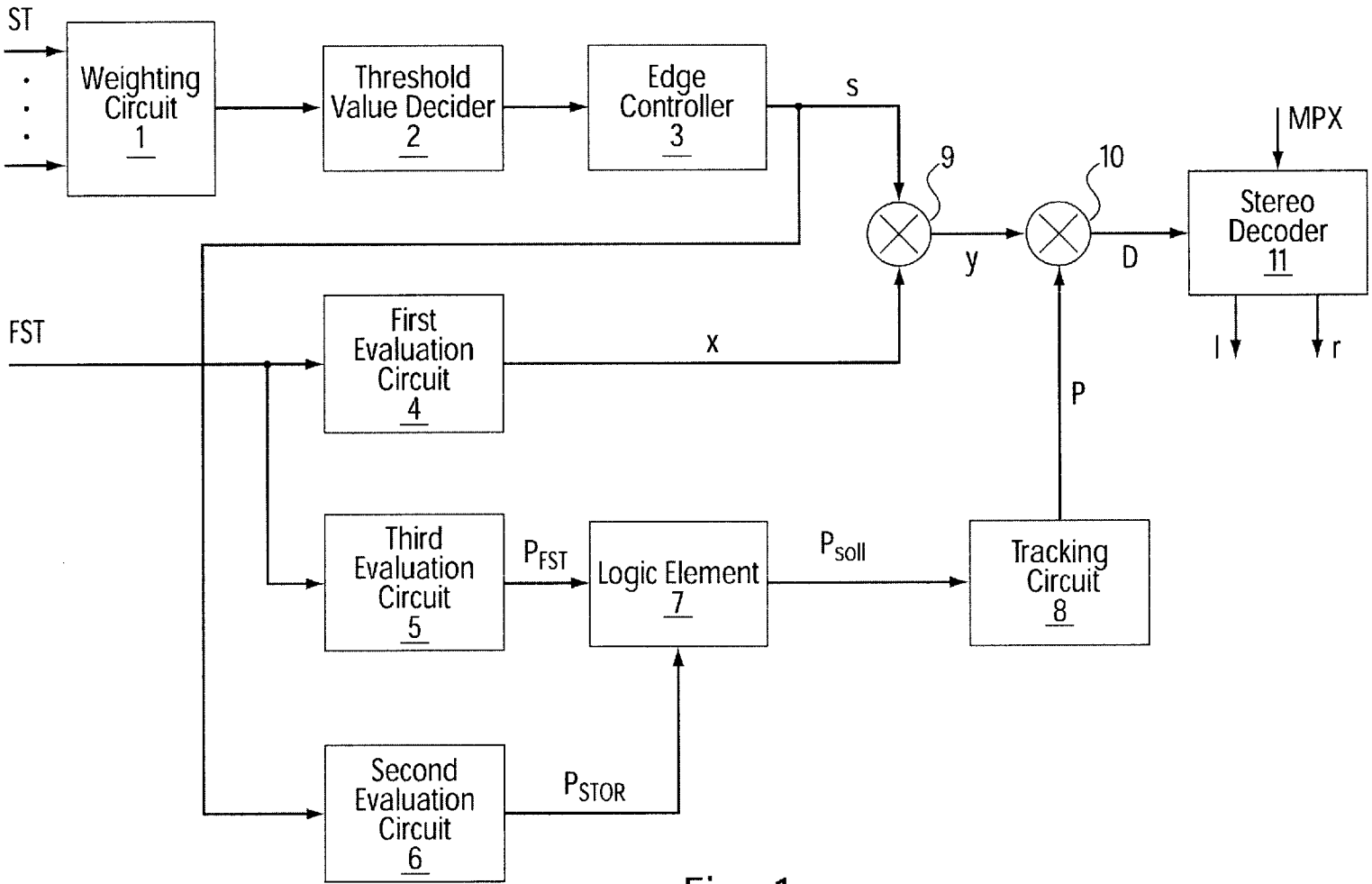
FIG. 1 shows a block diagram of an embodiment of a radio receiver according to the present invention.

An exemplary embodiment of a radio receiver according to the present invention, for carrying out the method according to the present invention, is depicted in FIG. 1.

Audio signals for a left and a right channel (l, r) can be tapped off at two outputs of a stereo decoder 11 to which a stereo multiplex signal MPX, obtained conventionally by demodulation of a received radio signal, is delivered.

Figure 3:
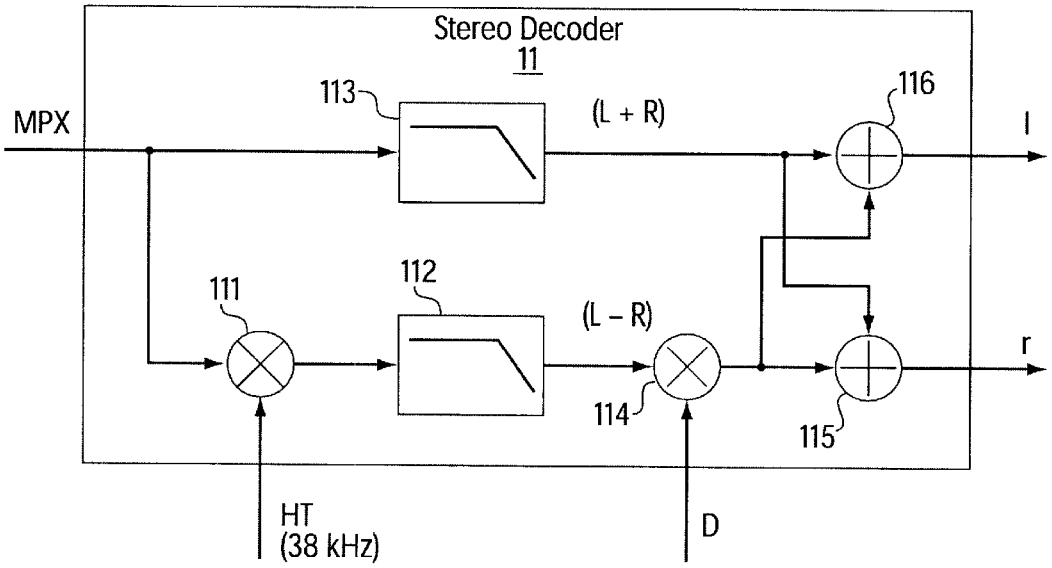
FIG. 3 shows an embodiment of a stereo decoder according to the present invention.

Formation of the audio signals for the left and right stereo channels l and r from stereo multiplex signal MPX is described with reference to the exemplary embodiment, depicted in FIG. 3, of stereo decoder 11 according to the present invention. Stereo multiplex signal MPX is processed in two signal paths, the summed signal (L+R) being isolated from the stereo multiplex signal MPX by low-pass filtration 113 thereof. In a second signal path, in-phase multiplication 111 times a 38-kHz auxiliary carrier (obtained, for example, from a 19-kHz pilot tone), and subsequent elimination of undesired mixed products by way of a low-pass filter 112, generates a difference signal (L−R) which contains the difference between the signals for the left and the right audio channels.

Following weighting 114 of difference signal (L−R) with a factor D ($0 \leqq D \leqq 1$), the weighted difference signal is added to summed signal (L+R) to form a signal 1 for the left audio channel (116), and subtracted from the summed signal to form a signal r for the right audio channel (115). The applicable equations are thus $$l=(L+R)+D(L-R)$$

and $$r=(L+R)-D(L-R),$$

wherein D=1 corresponds to maximum stereo channel separation and D=0 to purely monophonic reproduction.

By modifying the factor D, generation of which is the subject of the discussion which follows, it is therefore possible to establish any desired stereo channel separation between purely monophonic and purely stereophonic reproduction.

Interference signals (ST) exhibiting various types of reception interference—such as field strength fluctuations, multipath reception, and background noise—are delivered to a weighting circuit 1 contained in a first signal path 1 through 3 of the arrangement according to the present invention; these signals are individually weighted as a function of the value ranges occupied by them and their weighted influence on the stereo channel separation of an audio signal that is to be reproduced, and are combined with one another—in the present case, added up—to form a common interference signal.

The common interference signal is delivered to a threshold value decider 2, in which it is evaluated using a predefined threshold value, so that if the predefined threshold value is exceeded by the common interference signal, the output of threshold value decider 2 transitions from a first state into a second state. In the present case, the values 1 and 0 are selected for the first and the second state.

The output of threshold value decider 2 is delivered to an edge controller 3 for controlling the edge slope of the delivered signal. The controller 3 is configured such that its output signal, referred to hereinafter as first auxiliary interference signal s, abruptly assumes a fourth value when the output of the threshold value decider 2 transitions from the first into the second state, and, as soon as the output of threshold value decider 2 returns to the first value, returns to the third value in accordance with a predefined time function, e.g., within a few tens of milliseconds. In the present case, the predefined time function is carried out in the form of a linear profile, but provision can also be made for first auxiliary interference signal s to return to the third value, and thus back toward stereophonic reproduction, according to a nonlinear (e.g., exponential) profile.

Figure 4:
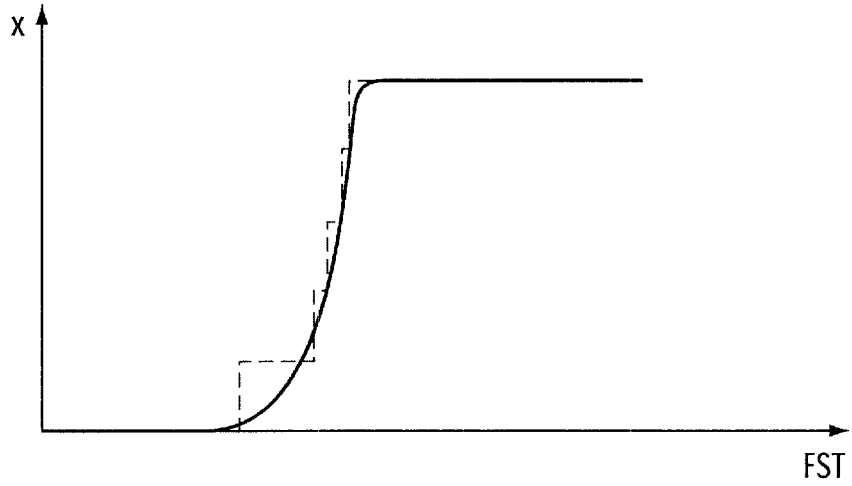
FIG. 4 shows an example of a characteristic curve implemented in an evaluation circuit according to the present invention.

In a second signal path of the arrangement according to the present invention, a field strength signal (FST) indicating the received field strength is delivered to a first evaluation circuit 4 to form a first auxiliary field strength signal x which characterizes the received field strength of the received radio signal. In the present case, field strength signal FST is generated by rectification and low-pass filtration of the intermediate frequency signal obtained by mixing the received signal down to the intermediate-frequency level. In first evaluation circuit 4, field strength signal FST is evaluated using a monotonically rising (in the present case, linear) characteristic curve, so that higher received field strengths result in higher values for first auxiliary field strength signal x. For high input values, the characteristic curve exhibits a saturation region, so that very high received field strengths do not result in any change in first auxiliary field strength signal x. The value range of the first auxiliary field strength signal lies, in the present case, between a value of 0 for a very low received field strength FST and a value of 1 for high and very high received field strengths. An example of a nonlinear characteristic curve implemented in first evaluation circuit 4 is depicted in FIG. 4.

A third signal path 5 through 8 includes a second evaluation circuit 6 for forming a signal which characterizes the frequency of reception interference events, i.e., the number of interference events per unit time, hereinafter referred to as second auxiliary interference signal $P_{stor}$, to which is delivered first auxiliary interference signal s.

Figure 2:
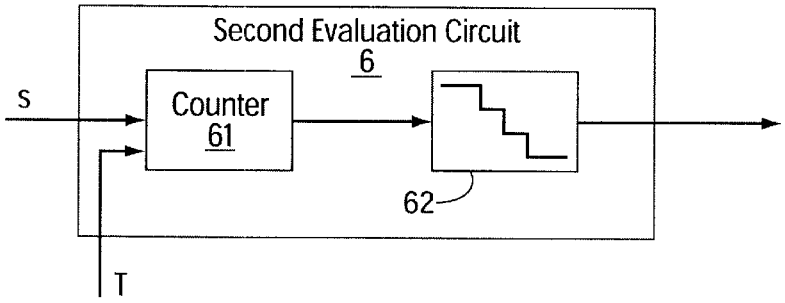
FIG. 2 shows an embodiment of an evaluation circuit according to the present invention.

An exemplary embodiment of second evaluation circuit 6 according to the present invention is depicted in FIG. 2. It includes a counter 61, in the present case, clock-timed by a digital signal processor, to which first auxiliary interference signal s is delivered. When first auxiliary interference signal s transitions into the fourth state indicating the presence of a reception interference event, counter 61 is incremented by a fifth predefined value, while in the absence of any interference event it is decremented by a sixth predefined value. In the present case, clock signal T delivered to the counter is derived from the sampling clock for the demodulated received signal, so that counter 61 operates synchronously with the sampled values of stereo multiplex signal MPX. Alternatively, however, it is also possible to generate clock signal T by way of a separate clock generator.

Figure 6:
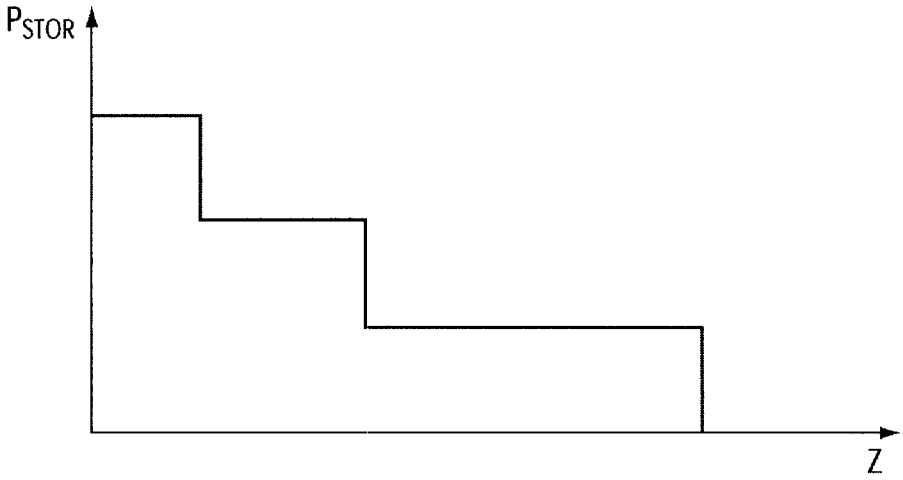
FIG. 6 shows an example of a monotonically decreasing characteristic curve implemented in an evaluation circuit according to the present invention.

The count at counter 61 is evaluated using a monotonically decreasing characteristic curve 62, so that high counts Z of counter 61 result in low values, and low counter counts Z in high values, for second auxiliary interference signal $P_{stor}$ at the output of second evaluation circuit 6. An example of characteristic curve 62 is depicted in FIG. 6, which illustrates the correlation between count Z of counter 61 and second auxiliary interference signal $P_{stor}$.

In an exemplary embodiment according to the present invention that is simplified by comparison with the exemplary embodiment according to the present invention depicted in FIG. 1, second auxiliary interference signal $P_{stor}$ obtained in this fashion, and indicating the frequency of reception interference events, corresponds to second auxiliary signal $P_{soll}$, from which an auxiliary channel separation signal P is obtained via a tracking circuit 8.

Tracking circuit 8 functions so that for values of second auxiliary signal $P_{soll}$ that are less than a current value of auxiliary channel separation signal P, the value of auxiliary channel separation signal P rapidly returns to the value of second auxiliary signal $P_{soll}$; while for values of second auxiliary signal $P_{soll}$ that are greater than a current value of auxiliary channel separation signal P, auxiliary channel separation signal P approaches the value of second auxiliary signal $P_{soll}$ slowly, in accordance with a predefined time function (in the present case, according to an exponential function: initially very quickly and then in increasingly slowly rising fashion).

In a development suitable for radio receivers that, in order to optimize the reception of a received radio program, perform an alternative frequency test, provision is made, during an alternative frequency test or a jump to an alternative frequency, for holding auxiliary channel separation signal P at the value immediately preceding the frequency jump or the alternative frequency test. Tracking circuit 8 activated again to track auxiliary channel separation signal P only after the alternative frequency test or the jump to an alternative frequency (in the case of a frequency change, to a transmission frequency that can be received better) is completed.

As an alternative to the deactivation of tracking circuit 8 for the duration of a frequency jump or an alternative frequency test, it is also possible to freeze second auxiliary signal $P_{soll}$ at its value immediately preceding any such event.

Figure 5:
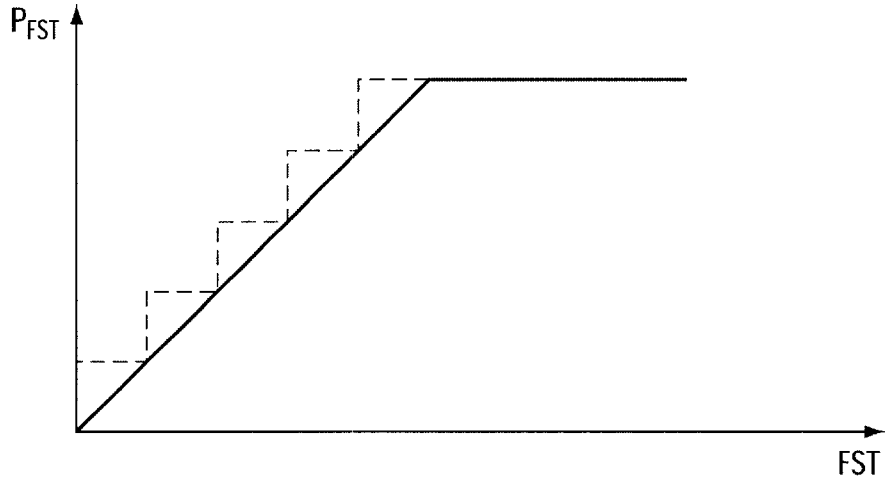
FIG. 5 shows another example of a characteristic curve implemented in an evaluation circuit according to the present invention.

In the exemplary embodiment of the arrangement according to the present invention depicted in FIG. 1, the third signal path furthermore has a third evaluation circuit 5 in which field strength signal FST is evaluated in order to form a second auxiliary field strength signal $P_{FST}$ having a second monotonically rising characteristic curve, an example of which is depicted in FIG. 5.

Second auxiliary field strength signal $P_{FST}$ and second auxiliary interference signal $P_{stor}$ are conveyed, in order to create a second auxiliary signal $P_{soll}$, to a logic element 7 in which, in the present case, the minimum of the two delivered second auxiliary signals $P_{stor}$, $P_{FST}$ is determined, and second auxiliary signal $P_{soll}$ is set to equal the lesser of the two auxiliary signals $P_{stor}$, $P_{FST}$.

In a variant of the present exemplary embodiment according to the present invention, provision is made for embodying logic element 7 as a multiplier, so that the second auxiliary signal is yielded as the product $P_{stor} \times P_{FST}$ of the two second auxiliary signals $P_{stor}$, $P_{FST}$, that are delivered.

The first auxiliary interference signal, first auxiliary field strength signal x, and auxiliary channel separation signal P are combined with one another in a second logic element 9, 10 to create the factor which influences the stereo channel separation. In the present case, this is done by multiplying first auxiliary interference signal s and first auxiliary field strength signal x, in a first multiplier 9, to create a first auxiliary signal. The resulting first auxiliary signal y is then weighted, in a second multiplier 10, with auxiliary channel separation signal P to yield factor D.

The resulting manner of operation for a radio receiver according to the present invention is as follows. Factor D is directly proportional to the first auxiliary field strength signal, so that the received field strength of the received radio signal has a direct effect on stereo channel separation. In the case of severe reception interference lying above a threshold value, a cross-fade occurs from stereophonic to monophonic reproduction by way of first auxiliary interference signal s. And lastly, either the interference frequency in the form of second auxiliary interference signal $P_{stor}$ (if the interference frequency is high), or the received field strength in the form of second auxiliary field strength signal $P_{FST}$ (if the received field strength is low), acts—depending on which of the two variables indicates poorer reception—via auxiliary channel separation signal P on the stereo channel separation so as to reduce it.

Signal ST mentioned initially, which indicates interference, is generated conventionally as follows:

A signal ΔFST indicating field strength fluctuations is derivable, for example, by continuously comparing a signal indicating the current received field strength (which can be generated, for example, by rectification of the intermediate-frequency signal) to the slowly changing field strength signal FST. In the simplest case, signal ΔFST indicating the field strength fluctuations can be created by subtracting the current field strength from field strength signal FST.

A signal indicating background noise can be obtained, for example, by analyzing the high-frequency signal components (e.g., those above 60 kHz) contained in stereo multiplex signal MPX.

An interference signal indicating multipath reception is derivable conventionally, for example, by analyzing the symmetry of the sidebands of 38-kHz auxiliary carrier HT; an asymmetry indicates multipath reception.

As depicted in FIGS. 4 through 6, the characteristic curves implemented in evaluation circuits 4 through 6 are embodied in the form of step functions, which are shown in FIGS. 4 and 5 with dashed lines, so that the number of possible output values and thus the word width of signals x, S, $P_{stor}$, and $P_{FST}$ is finite and, when the number of steps is small, is also small. Embodying the characteristic curves as step functions having a small number of steps makes it possible to represent them using a small number of comparators.

What is claimed is:

1. A method for influencing, in a radio receiver, a stereo channel separation of an audio signal to be reproduced, the audio signal being obtained from a received radio signal, the method comprising the steps of:

(a) combining a sum signal and a difference signal, the combining yielding a signal for a left channel and a signal for a right channel of the audio signal in a stereo decoder;

(b) delivering a factor to the stereo decoder, the factor influencing the stereo channel separation between the signal for the left channel and the signal for the right channel;

(c) generating a first auxiliary field strength signal from a received field strength of the received radio signal, the first auxiliary field strength being indicative of the received field strength of the received radio signal;

(d) generating a first auxiliary interference signal from at least one signal for indicating reception interference events, the first auxiliary interference signal being indicative of the reception interference events, the at least one signal being derived from the received radio signal; and (e) yielding the factor by combining the first auxiliary field strength signal, the first auxiliary interference signal and an auxiliary channel separation signal, the auxiliary channel separation signal being generated from a second auxiliary interference signal, the second auxiliary interference signal being derived from the first auxiliary interference signal, the second auxiliary interference signal being indicative of a number of the reception interference events per time interval.

2. The method according to claim 1, wherein the generating of step (c) includes the step of using a monotonically rising characteristic curve, the monotonically rising characteristic curve having a saturation region for high input values.

3. The method according to claim 1, wherein the second auxiliary interference signal is derived from the first auxiliary interference signal by using a monotonically decreasing characteristic curve.

4. The method according to claim 1, further comprising the steps of:

(f) generating a second auxiliary field strength signal from the received field strength of the received radio signal, the second auxiliary field strength signal being indicative of the received field strength of the received radio signal; and (g) combining the second auxiliary field strength signal and the second auxiliary interference signal to create the auxiliary channel separation signal.

5. The method according to claim 4, wherein the generating of step (f) includes the step of using a monotonically rising characteristic curve.

6. The method according to claim 4, wherein the combining of step (g) includes the step of creating a minimum of the second auxiliary field strength signal and the second auxiliary interference signal.

7. The method according to claim 1, wherein the yielding of step (e) includes the steps of:

multiplying the first auxiliary field strength signal by the first auxiliary interference signal to yield a first further auxiliary signal; and multiplying the first further auxiliary signal by the auxiliary channel separation signal to yield the factor.

8. The method according to claim 1, further comprising the steps of:

temporarily tuning the radio receiver to an alternative transmission frequency in order to optimize reception, the alternative transmission frequency being different from a current received transmission frequency, a received radio program being carried on both the alternative transmission frequency and the current received transmission frequency;

determining a reception quality of the received radio program on the alternative transmission frequency during a dwell time on the alternative transmission frequency; and holding at a value present immediately preceding a frequency change for at least one of a duration of a transition from the current to the alternative transmission frequency, the duration of the transition from the alternative transmission frequency to the current received transmission frequency and the duration defined for the determining of the reception quality at least one of (A) a second auxiliary signal at least one of corresponding to the second auxiliary interference signal and being generated from a combination of the second auxiliary interference signal and the second auxiliary field strength signal and (B) the auxiliary channel separation signal being derived from the second auxiliary signal.

9. A radio receiver for influencing a stereo channel separation of an audio signal to be reproduced, the audio signal being obtained from a received radio signal, comprising:

a stereo decoder for generating the audio signal for a left channel and a right channel from a sum signal and a difference signal, the stereo channel separation being influenced by a delivered factor;

a first signal path on which a first auxiliary interference signal is generated from at least one signal indicating reception interference events, the first auxiliary interference signal being derived from the received radio signal;

a second signal path on which a first auxiliary field strength signal is generated from a received field strength of the received radio signal via a first evaluation circuit, the first auxiliary field strength signal being indicative of the received field strength of the received radio signal;

a third signal path on which an auxiliary channel separation signal is generated, the third signal path including a second evaluation circuit in which a second auxiliary interference signal is generated from the first auxiliary interference signal, the second auxiliary interference signal being indicative of a number of the reception interference events per time interval, the auxiliary channel separation signal being derived from the second auxiliary interference signal; and a second logic element for combining the auxiliary channel separation signal with the first auxiliary interference signal and the first auxiliary field strength signal.

10. The radio receiver according to claim 9, wherein the second logic element includes a first multiplier and a second multiplier, the first auxiliary field strength signal and the first auxiliary interference signal being delivered to the first multiplier, the first multiplier generating a further auxiliary signal, the further auxiliary signal and the second auxiliary interference signal being delivered to the second multiplier, the second multiplier yielding the delivered factor.

11. The radio receiver according to claim 10, wherein the third signal path includes:

a third evaluation circuit for generating a second auxiliary field strength signal from the received field strength of the received radio signal; and a first logic element for combining the second auxiliary field strength signal with the second auxiliary interference signal, the first logic element yielding the auxiliary channel separation signal.

12. The radio receiver according to claim 11, wherein the first logic element yields the auxiliary channel separation signal by determining a minimum of the second auxiliary field strength signal and the second auxiliary interference signal that are delivered to the first logic element.

13. The radio receiver according to claim 9, wherein the first signal path includes a threshold value decider for evaluating at least one signal indicating reception interference events, the threshold value decider having an output, the output transitioning from a first condition to a second condition if the at least one signal indicating reception interference events exceeds a predefined threshold.

14. The radio receiver according to claim 13, wherein the first condition has a value of 1 and wherein the second condition has a value of 0.

15. The radio receiver according to claim 13, wherein the first signal path further includes an edge controller having an output, the edge controller controlling an edge slope of a delivered signal such that at least one of (A) when the delivered signal transitions from a first state to a second state, the output of the edge controller transitions abruptly from a third value to a fourth value and (B) when the delivered signal transitions from the second state to the first state, the output of the edge controller transitions, in accordance with a predefined time function, from the fourth value to the third value, the delivered signal being the output of the threshold value decider.

16. The radio receiver according to claim 15, wherein the third value is 1 and wherein the fourth value is 0.

17. The radio receiver according to claim 9, wherein the first signal path includes a weighting circuit, the weighting circuit individually weighting at least one signal indicating reception interference events, the at least one signal being grouped into one common interference signal.

18. The radio receiver according to claim 10, wherein the received field strength of the received radio signal is evaluated in the first evaluation circuit and the third evaluation circuit by, in each case, using a characteristic curve that rises monotonically, the first evaluation circuit providing a limitation on the first auxiliary field strength signal for large values of the received field strength, the third evaluation circuit providing a limitation on the second auxiliary field strength signal for large values of the received field strength.

19. The radio receiver according to claim 18, wherein the characteristic curve includes a step function.

20. The radio receiver according to claim 9, wherein the second evaluation circuit includes a counter, the first auxiliary interference signal being delivered to the counter, the counter being incremented by a predefined fifth value when the first auxiliary interference signal indicates the reception interference event, the counter being decremented by a predefined sixth value when the first auxiliary interference signal indicates an absence of any reception interference event, a count of the counter being evaluated via a monotonically decreasing characteristic curve.

21. The radio receiver according to claim 20, wherein the monotonically decreasing characteristic curve includes a step function.

* * * * *